United States Patent [19]

Dobbs

[11] 4,152,858

[45] May 8, 1979

[54] FAST LOADER FOR MUZZLE-LOADER

[76] Inventor: Harold L. Dobbs, 413 Goodreau Ln., Glide, Oreg. 97443

[21] Appl. No.: 825,152

[22] Filed: Aug. 16, 1977

[51] Int. Cl.[2] ..... F41C 27/00

[52] U.S. Cl. ..... 42/90; 86/33

[58] Field of Search ..... 86/23–46; 42/90, 87

[56] References Cited

U.S. PATENT DOCUMENTS

| | | | |
|---|---|---|---|
| 13,547 | 9/1855 | Johnson | 86/33 |
| 133,040 | 11/1872 | Lavalle | 86/33 |
| 163,404 | 5/1875 | Phillips | 42/87 |
| 243,250 | 6/1881 | Hall | 42/90 |
| 3,747,252 | 7/1973 | Walker | 42/90 |
| 4,050,175 | 9/1977 | Mulinix | 42/90 |

*Primary Examiner*—Harold J. Tudor

*Attorney, Agent, or Firm*—Clarence A. O'Brien; Harvey B. Jacobson

[57] ABSTRACT

An apparatus is provided for forming a charge for a muzzle-loading gun and including a predetermined amount of powder and a bullet at least partially embraced within a patch. After the charge is formed, it may be retained in readiness for quick insertion into the muzzle end of the barrel of a muzzle-loader. The tool includes a tubular body defining a first bore extending longitudinally therethrough and having a diametrically enlarged counterbore opening outwardly of one end of the body. The interior of the body defines a shoulder at the inner end of the counter bore and a sleeve has one end thereof loosely removably telescoped into the counterbore and defines a second bore extending therethrough of substantially the same diameter as the bore formed through the body. The second bore is of a diameter to snugly and slidably receive a bullet of a predetermined size therein at least partially embraced within a patch and the outside diameter of the sleeve is smaller than the diameter of the counterbore of the body by an amount enabling a thin, frangible and flexible disk of a larger plan area than the counterbore to extend across the end of the sleeve telescoped into the counterbore with the peripheral portions of the disk clamped between the outer surfaces of the sleeve and the opposing surfaces of the counterbore adjacent the inner end thereof.

10 Claims, 8 Drawing Figures

FAST LOADER FOR MUZZLE-LOADER

BACKGROUND OF THE INVENTION

Various devices have been heretofore provided to facilitate the loading of muzzle-loaders and to enable a muzzle-loader to be more rapidly loaded. However, most of these previously known devices have not included means by which a complete charge for a muzzle-loader may be held in readiness for use and which may be rapidly loaded into the muzzle end of the barrel of a muzzle-loader. Accordingly, a need exists for an apparatus by which a complete charge for a muzzle-loader may be held in readiness and, whenever desired, utilized to rapidly load a muzzle-loader.

Various examples of previously patented muzzle-loading devices including some of the basic structural and operational features of the instant invention are disclosed in U.S. Pat. Nos. 163,404, 184,079, and 3,747,252.

BRIEF DESCRIPTION OF THE INVENTION

The hand tool of the instant invention includes structure by which a complete charge for a muzzle-loading gun including a predetermined amount of powder and a bullet at least partially embraced within a patch may be retained in readiness and subsequently, whenever desired, rapidly transferred from the tool into the muzzle end of a muzzle-loader.

The main object of this invention is to provide an apparatus which will facilitate the loading of a muzzle-loading gun.

Another object of this invention is to provide a tool which will enable a plurality of charges for a muzzle-loading gun to be held in readiness and to be sequentially transferred from the tool into the muzzle end of the barrel of a muzzle-loader.

Still another object of this invention is to provide an apparatus including a tool for containing a complete charge for a muzzle-loader and including structure whereby the tool may be properly indexed relative to the muzzle-loading gun to be loaded for ease in direct transfer of the charge from the tool to the muzzle of the gun to be loaded.

A still further object of this invention is to provide a tool for forming and containing a complete charge for a muzzle-loader and constructed in a manner whereby the complete charge contained therein will be protected from the elements.

A final object of this invention to be specifically enumerated herein is to provide a tool in accordance with the preceding objects and which will conform to conventional forms of manufacture, be of simple construction and easy to use, so as to provide a device that will be economically feasible, long lasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
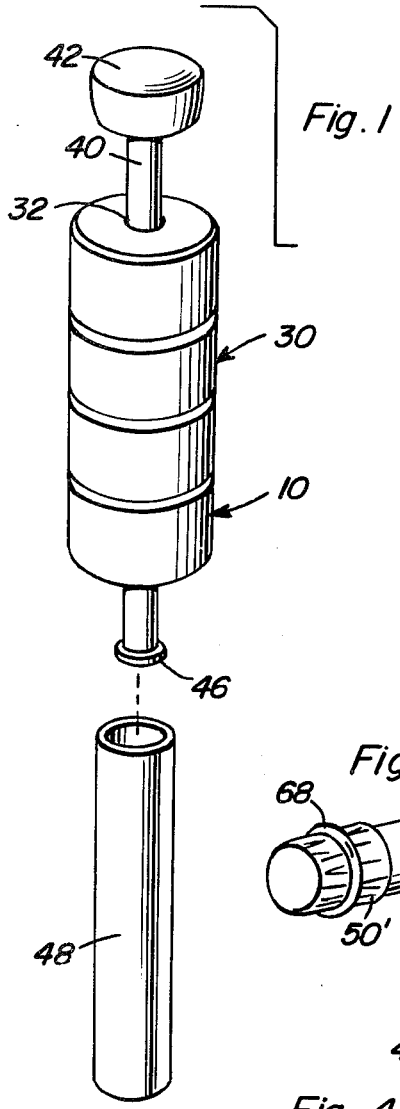
FIG. 1 is an exploded, perspective view of a first form of loader constructed in accordance with the present invention.

Referring now more specifically to the drawings, the numeral 10 generally designates a first form of tool constructed in accordance with the present invention. The tool 10 includes a first tubular body referred to in general by the reference numeral 12 defining a longitudinal bore 14 extending therethrough. The bore 14 includes a first diametrically enlarged counterbore 16 opening outwardly of one end 18 of the body 12 and a second larger diameter counterbore 20 opening outwardly of the other end of the body 12. The interior of the body defines an annular shoulder 22 at the inner end of the counterbore 16 facing outwardly of the end 18 of the body 12. In addition, an annular shoulder 24 is defined at the inner end of the counterbore 20 and opens outwardly of the second end 26 of the body 12. Also, it will be noted that the first end 18 of the body 12 includes a diametrically reduced externally threaded neck 28.

In addition to the body 12, the tool 10 also includes a second tubular body referred to in general by the reference numeral 30 and including a bore 32 formed therethrough. The bore 32 includes a first smooth counterbore 34 opening outwardly of the first end 36 of the body 30 and the body 30 further includes a second threaded counterbore 38 at the outer end of the counterbore 34 and which opens outwardly of the end 36 of the body 30.

An operating rod 40 is slidably received through the bore 32 and includes a diametrically enlarged abutment 42 on the end thereof projecting outwardly of the second end 44 of the body 30 remote from the end 36. Further, the rod 40 includes an enlarged head 46 on the end thereof remote from the abutment 40.

In addition to the bodies 12 and 30, the tool 10 includes a sleeve 48. The sleeve 48 is snugly receivable within the counterbore 34 and is loosely receivable in the counterbore 16. Further, the inside diameter of the sleeve 48 is substantially equal to the diameter of the bore 14.

Figure 2:
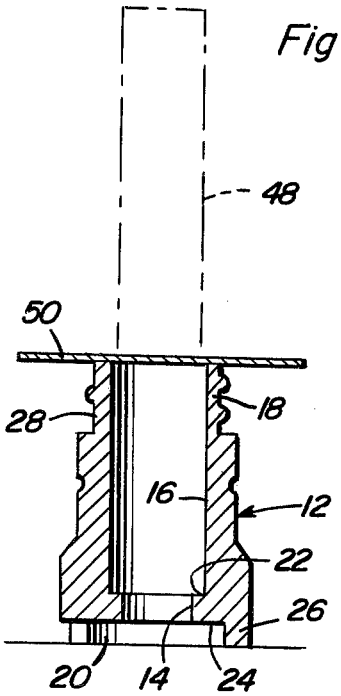
FIG. 2 is a sectional view of the charge containing end portion of the tool taken substantially upon a plane passing through the center thereof and with the charge containing end of the tool positioned preparatory to receiving a charge retaining frangible disk therein.
Figure 4:
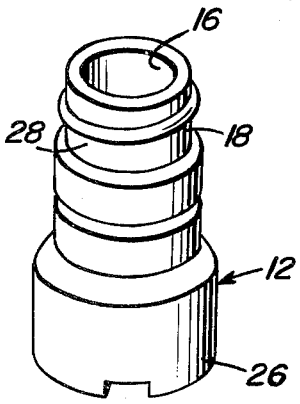
FIG. 4 is a longitudinal, sectional view of the complete tool illustrating the manner in which the plunger thereof may be utilized to directly transfer the charge from the tool into the muzzle end of an associated muzzle-loader.
Figure 4:
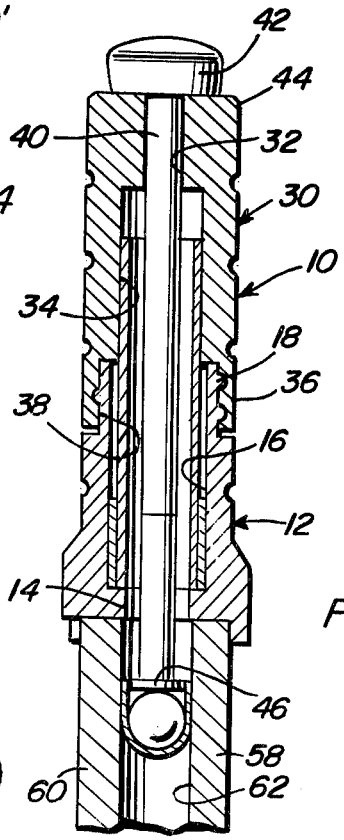
Figure 6:
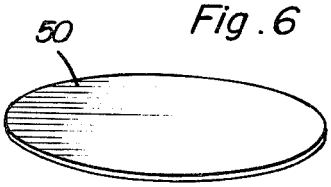
FIG. 6 is a perspective view of the frangible charge retaining flexible disk illustrated in FIG. 2.

In operation, a thin flexible and frangible disk 50 of a larger diameter than the counterbore 16 is placed over the outer end of the counterbore and across the end 18 of the body 12 in the manner illustrated in FIG. 2. Then, the sleeve 48 is positioned in the manner illustrated by the phantom lines in FIG. 2 and telescoped downwardly into the counterbore 16 whereby the outer periphery of the disk 50 is clamped between the outer surfaces of the sleeve 48 and the opposing inner surfaces of the counterbore 16. Thereafter, a predetermined quantity of powder 52 is loaded into the sleeve 48 and drops to the bottom thereof on top of that portion of the disk 50 extending across the bottom of the sleeve 48 and a wad 54 is placed over the upper end of the sleeve 48 and a bullet (ball) 56 is then placed on the wad 54 over the upper end of the sleeve 48 and forced down into the sleeve 48 until the wad or patch embraced bullet 56 seats against the powder 52. At this point, the charge comprising the powder 52, the patch 54 and the bullet 56 are contained within the body 12 of the tool 10 and the body 12 may be positioned over the muzzle end 58 of the barrel 60 of a muzzle-loader with the muzzle end of the barrel 60 received within the counterbore 20 in order to align the bore 14 with the bore 62. Thereafter, the ramrod 64 of the muzzle-loader may be used to engage the bullet 56 and and to force the patch 54, the bullet 56 and the powder 52 through that portion of the frangible disk 50 extending across the upper end of the bore 14 and down into the bore 62 of the barrel 60. However, the body 30 of the tool 10 may be threaded onto the neck 18 of the body 12 in the manner illustrated in FIG. 4 of the drawings with the rod 40 in a retracted position to position the head 46 in the inner end of the counterbore 34 above the charge comprising the powder 52, the wad or patch 54 and the bullet 56 within the lower end of the sleeve 48. Thereafter, when the tool 10 has been positioned over the muzzle end 58 of the barrel 60, the abutment 42 may be depressed downwardly in order that the rod 40 may have its head engaged with the bullet 56 and further subsequent downward movement of the rod 40 will effect passage of the charge through that portion of the disk 50 extending across the upper end of the bore 14 in order to transfer the charge from the tool 10 into the bore 62 of the barrel 60. Thereafter, the ramrod 64 may be used to displace the bullet 56 and the wad or patch 54 toward the breech end of the bore 62, the powder 52 having already fallen to the breech end of the bore 62 upon the disk 50 being ruptured.

Figure 3:
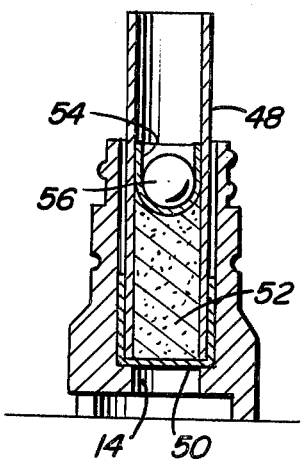
FIG. 3 is a sectional view similar to FIG. 2 but with a complete charge contained within the tool end illustrated in FIG. 2.
Figure 7:
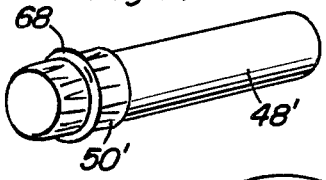
FIG. 7 is a perspective view of a charge containing sleeve portion of a modified form of tool constructed in accordance with the present invention.
Figure 5:
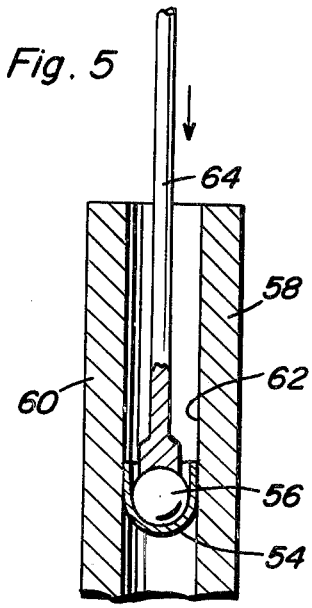
FIG. 5 is a fragmentary, sectional view of the muzzle end of a muzzle-loader illustrating the manner in which a ramrod may be utilized to effect movement of the patch embraced bullet of the charge from the muzzle end of the barrel to the breach end thereof.
Figure 8:
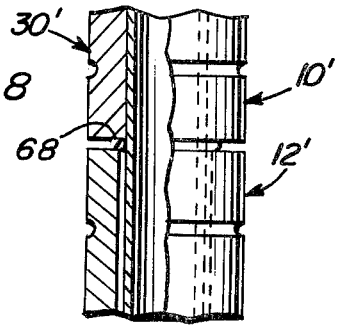
FIG. 8 is a fragmentary, longitudinal sectional view of the center portion of the modified form of tool in assembled condition.

With attention now invited more specifically to FIGS. 7 and 8 of the drawings, a modified form of tool is referred to in general by the reference numeral 10'. Tool 10' is substantially identical to the tool 10 and, therefore, has its components corresponding to the various components of the tool 10 designated by prime reference numerals corresponding to those designating the similar components of the tool 10. The tool 10' differs from the tool 10 in that the body 12' is not provided with the diametrically reduced externally threaded neck 18 and the body 30' does not include the threaded second counterbore 38. Rather, the tool 10' includes an O-ring seal 68 for insuring a weather-tight seal between the bodies 12' and 30'. Also, it is to be noted that additional sleeves 48' corresponding to the sleeve 48 may be provided and that each additional sleeve 48' may have a flexible and frangible disk 50' secured over one end thereof by means of an associated O-ring seal 68. Therefore, a plurality of the sleeves 48' may have complete charges disposed therein and after one charge has been fired from the muzzle-loader, the bodies 12' and 30' may be separated, the expended sleeve 48' may be removed and a second sleeve 48' containing a new charge may be telescoped into the body 12' and thereafter have the body 30' telescoped over the end thereof projecting outwardly of the body 12'. Further, with reference again to FIGS. 1, 2 and 3 of the drawings, additional body and sleeve assemblies 12 and 48 containing complete charges comprising the powder 52, the wad or patch 54 and the bullet 56 retained within the additional bodies 12 by means of frangible disks 50 may be utilized in substantially the same manner as the additional sleeves 48' in order to contain preformed auxiliary charges. In this manner, the tool 10 may also be utilized as a means to provide a plurality of charges which may be rapidly loaded into a muzzle-loader. Of course, as hereinbefore set forth, ther tool 10 may comprise only those components of the tool 10 illustrated in FIG. 3 and the ramrod 64 of the muzzle-loader may be utilized to transfer the charge from the assembly of FIG. 3 directly into the bore 62 of the barrel 60.

What is claimed as new is as follows:

1. A hand tool for forming a charge for a muzzle-loading gun and including a predetermined amount of powder and a bullet at least partially embraced within a patch, said tool including a tubular body defining a first bore extending longitudinally therethrough and including a diametrically enlarged counterbore opening outwardly of one end of said body, the interior of said body defining a shoulder facing outwardly of said one end at the inner end of said counterbore, a sleeve of larger outside diameter than the diameter of said first bore and having one end loosely removably telescoped into said counterbore from said one end of said body and defining a second bore extending therethrough of substantially the same diameter as said first bore, said second bore being of a diameter adapted to snugly and slidably receive a bullet of a predetermined size therein at least partially embraced within a patch, and the outside diameter of said sleeve being smaller than the diameter of said counterbore by an amount enabling a thin, frangible and flexible disk of a larger plan area than said counterbore to extend across said one end of said sleeve telescoped into said counterbore with the peripheral portions of said disk clamped between the outer surfaces of said one end of said sleeve and the opposing surfaces of said counterbore adjacent the inner end thereof.

2. The combination of claim 1 including a thin, flexible and frangible disk of a larger plan area than said counterbore extending across said one end of said sleeve with the peripheral portions of said disk clamped between the outer surfaces of said one end of said sleeve and the opposing surfaces of said counterbore adjacent the inner end thereof.

3. The combination of claim 1 wherein said sleeve is of a greater length than the length of said counterbore and projects outwardly of said one end of said counterbore, a second tubular body defining a third bore extending longitudinally therethrough and including a second counterbore at one end of a diameter slightly smaller than the diameter of the first mentioned counterbore and in which the other end of said sleeve is snugly telescopingly engaged, a plunger rod reciprocal through said third bore and including an enlarged head on one end of a diameter greater than the diameter of said third bore and telescoped in said second bore for engagement with said bullet, the effective length of said rod and head being greater than the combined lengths of said bores and counterbores.

4. The combination of claim 3 wherein the other end of said plunger rod projects outwardly of the corresponding end of said third bore and includes an abutment of a size too great to pass through said third bore.

5. The combination of claim 3 wherein the said tubular bodies include adjacent ends, one of said adjacent ends defining a threaded counterbore and the other adjacent end defining a diametrically secured externally threaded neck removably threadedly engaged in said threaded counterbore.

6. The combination of claim 5 wherein the end of the first mentioned tubular body remote from said second tubular body includes a diametrically enlarged counterbore adapted to snugly receive the muzzle end of a muzzle-loading gun barrel therein.

7. The combination of claim 6 wherein the other end of said plunger rod projects outwardly of the corresponding end of said third bore and includes an abutment of a size too great to pass through said third bore.

8. The combination of claim 7 including a thin, flexible and frangible disk of a larger plan area than said counterbore extending across said one end of said sleeve with the peripheral portions of said disk clamped between the outer surfaces of said counterbore adjacent the inner end thereof.

9. The combination of claim 3 including an annular sealing ring encircling said sleeve between the adjacent ends of said tubular body.

10. The combination of claim 9 including a thin, flexible and frangible disk of a larger plan area than said counterbore extending across said one end of said sleeve with the peripheral portions of said disk clamped between the outer surfaces of said one end of said sleeve and the opposing surfaces of said counterbore adjacent the inner end thereof.

* * * * *